US008174936B2

(12) United States Patent
Papi

(10) Patent No.: US 8,174,936 B2
(45) Date of Patent: May 8, 2012

(54) TIMEPIECE WITH RINGING MECHANISM

(75) Inventor: Alberto Papi, La Chaux-de-Fonds (IT)

(73) Assignees: Vaucher Manufacture Fleurier S.A., Fleurier (CH); Sowind S.A., La Chaux-de-Fonds (CH)

( * ) Notice: Subject to any disclaimer, the term of this patent is extended or adjusted under 35 U.S.C. 154(b) by 299 days.

(21) Appl. No.: 12/675,029

(22) PCT Filed: Aug. 29, 2008

(86) PCT No.: PCT/EP2008/061431

§ 371 (c)(1),
(2), (4) Date: Feb. 24, 2010

(87) PCT Pub. No.: WO2009/027526

PCT Pub. Date: Mar. 5, 2009

(65) Prior Publication Data

US 2011/0116348 A1 May 19, 2011

(30) Foreign Application Priority Data

Aug. 30, 2007 (EP) ..... 07115329

(51) Int. Cl.
*G04B 21/02* (2006.01)
*G04B 21/00* (2006.01)

(52) U.S. Cl. ..... 368/75; 368/267

(58) Field of Classification Search ..... 368/75, 368/248, 267–270, 273
See application file for complete search history.

(56) References Cited

U.S. PATENT DOCUMENTS

| | | | | |
|---|---|---|---|---|
| 587,574 | A | 8/1897 | Gabriel | |
| 1,421,801 | A | 7/1922 | Marsh | |
| 1,556,184 | A * | 10/1925 | Volpo | 368/268 |
| 7,330,403 | B2 * | 2/2008 | Goeller | 368/75 |
| 7,773,463 | B2 * | 8/2010 | Corthesy et al. | 368/75 |

OTHER PUBLICATIONS

Reymondin et al, "Theorie de I'horlogerie", Federation des Ecoles Techniques, 1998, ISBN 2-940025-10-X, pp. 219 to 224.
F. LeCoultre, "Les montres compliquees", Editions Horlogeres, pp. 128-131.
International Search Report dated Dec. 4, 2008, from corresponding PCT application.
European Search Report dated May 16, 2008, from corresponding European Search Report.

* cited by examiner

*Primary Examiner* — Vit Miska
(74) *Attorney, Agent, or Firm* — Young & Thompson

(57) ABSTRACT

A timepiece includes a movement and a current-time ringing mechanism that includes: an hour cam (40) for providing information on the hour of the current time to an hour sampler, quarter cam (28) for providing information on the quarters of the current time to a quarter sampler, a minute cam (22) for providing information on the minutes of the current time to a minute sampler, wherein the cams are adapted to be driven by the movement, the quarter cam (28) and the minute cam (22) being pivotally mounted and being free relative to each other, and the minute cam (22) including a snail including a single row of 60/N stages and being adapted to be driven by the movement at N revolutions per hour.

10 Claims, 2 Drawing Sheets

TIMEPIECE WITH RINGING MECHANISM

TECHNICAL FIELD

The present invention relates to the field of mechanical horology. It more particularly concerns a timepiece comprising a movement and a current-time ringing mechanism comprising:

- an hour cam for providing information on the hour of the current time to an hour feeler-spindle,
- a quarter cam for providing information on the quarters of the current time to a quarter feeler-spindle,
- a minute cam for providing information on the minutes of the current time to a minute feeler-spindle,
- the cams being designed to be driven by the movement.

BACKGROUND OF THE INVENTION

This type of mechanism makes it possible to indicate, upon request, the time to the closest minute, using strokes struck by two hammers on two different gongs. They can thus also make it possible to strike the hours and quarters as they pass. The hammers are actuated by lifts which are raised by a ringing mechanism. This mechanism comprises an hour rack, a quarter rack and a minute rack, provided with twelve, three and fourteen teeth, respectively, to strike the hours, quarters and minutes.

In the ringing mechanisms of the prior art, in order to adjust the movement of these racks, an hour cam is arranged on a twelve-tooth star, advancing one pitch per hour, while a quarter cam and a minute cam can be adjusted on a pivot shank. Three levers, each provided with a feeler-spindle cooperating with these cams, make it possible to determine the travel of the hour, quarter and minute racks and adjust the number of strokes struck.

Other details on this type of complication may be found, in particular on the driving force of the repeater or on the unhooking step, i.e. the triggering of the ringing mechanism, in the book "Théorie de l'horlogerie" by Reymondin et al, Fédération des Ecoles Techniques, 1998, ISBN 2-940025-10-X, pages 219 to 224.

The minute cam is thus driven at a rate of one revolution per hour and comprises four arms, one for each quarter, each arm being provided with fifteen regularly distributed stages.

It is a very difficult exercise for the watchmaker to adjust the four arms of the minute cam such that, on each of the stages, the minute ringing mechanism works correctly. Indeed, due to the complexity of a striking mechanism, in particular a minute repeater, the minute feeler-spindle has, from one piece to the next, different play or a slightly offset position, which necessarily involves, given the dimensions of the elements, individually adjusting each stage. Furthermore, from one arm to the next, the adjustment must obviously be reproduced faithfully, which is very delicate.

The aim of the present invention is to propose a ringing mechanism with easier adjustment and implementation by the horologist.

BRIEF DESCRIPTION OF THE INVENTION

More precisely, the invention concerns a timepiece in which the quarter cam and the minute cam are pivotally mounted and are free in relation to each other, and in which the minute cam is made up of a snail including a single row of 60/N stages and being designed to be driven by the movement at a rate of N revolutions per hour. Advantageously, the energy transmitted by the movement to the cams is brought to a train coaxial to the minute cam, then transmitted to a train coaxial to the quarter cam and, lastly, transmitted to a train coaxial to the hour cam.

According to one preferred embodiment, the quarter cam and the minute cam are mounted pivoting on two separate shafts.

Advantageously, the minute cam is coaxial with a plate designed to transmit the energy received by the movement to the train coaxial to the quarter cam, the gear ratio between said plate and said train being determined such that the quarter cam performs one revolution per hour.

The timepiece according to the invention may also comprise one or the other of the following characteristics:

- N is equal to 4,
- the plate drives a setting wheel cooperating with said train coaxial to the quarter cam, a jumper acting on said setting wheel or on said train in order to position the quarter cam,
- the plate and the minute cam are mounted with play rotating in relation to each other.

BRIEF DESCRIPTION OF THE DRAWINGS

Other characteristics of the present invention will appear more clearly upon reading the following description, done in reference to the appended drawing, in which.

DETAILED DESCRIPTION OF THE INVENTION

Figure 1:
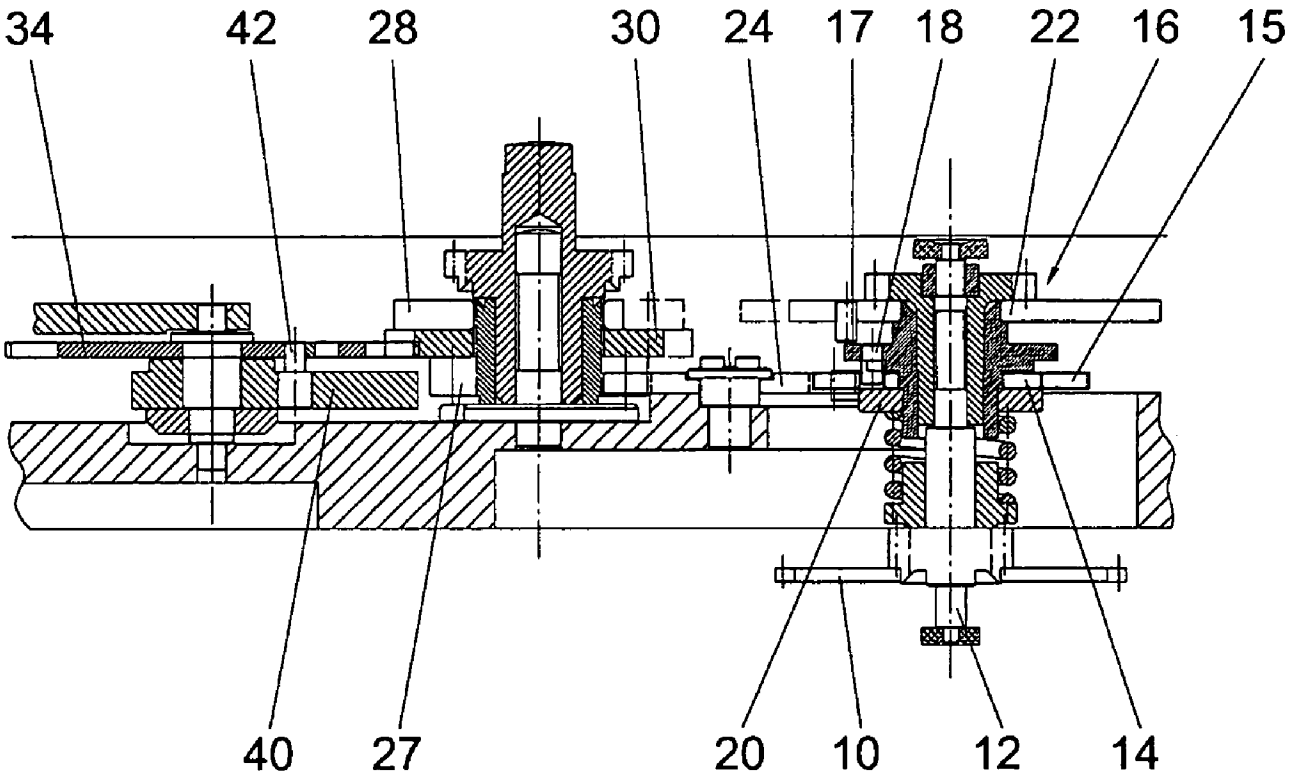
FIGS. 1 and 2 are cross-sectional and top views, respectively, of the cams of a ringing mechanism according to the invention.
Figure 2:
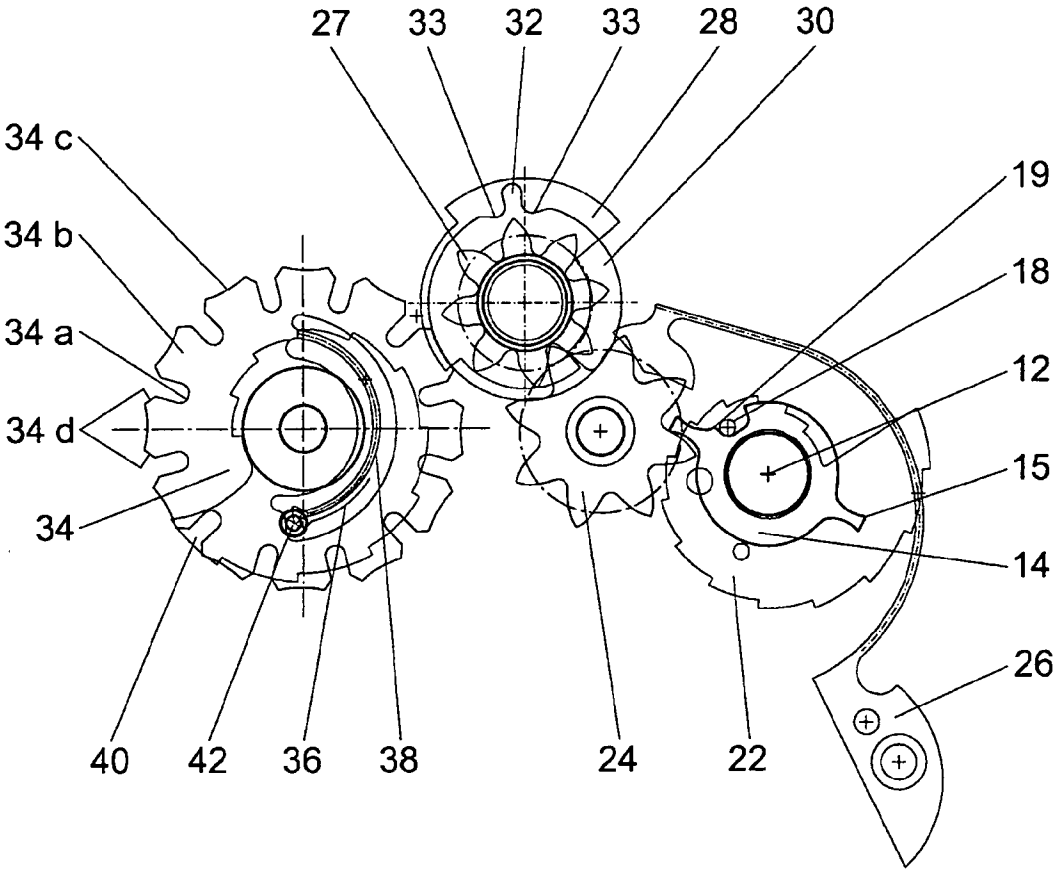

In the illustrated example, the driving force transmitted by the base movement in order to drive the cams reaches the cam system via a wheel 10 performing four revolutions per hour. This wheel is mounted integral with the first end of an arbor 12 supported by a plate 14 provided with two diametrically opposite fingers 15. More precisely, the plate 14 is free in rotation on a socket 16 frictionally mounted on the arbor 12. The socket has a shoulder 17, into which an index 18 is driven. This cooperates with the rim 19 of an opening provided in the plate 14. The opening is larger than the index so as to allow relative play between the plate and the arbor. In order to axially maintain the plate 14, a washer 20 is fitted on the arbor 12 such that the plate is maintained between the shoulder 17 and the washer 20.

A minute cam 22 made up of a snail comprising a single row of fifteen stages, resembling a conventional hour cam, is mounted integral on the socket 16, at its second end. One may refer to the book "Les montres compliquées", by F. Lecoultre, Editions Horlogères, which explains, on pages 128-131, how to dimension the stages of the cams. It would also be possible to use a cam having a continuous radius variation and which, therefore, would not comprise stages, but would simply be a spiral. In this case, in order to avoid the ringing mechanism being triggered between two minutes, the cam can be driven by pitch, for example by arranging a jumper at the drive system of the cam.

Thus, according to one important aspect of the invention, the minute cam 22 only comprises a single row of stages forming what one could call a single arm, and does not comprise several arms. The watchmaker adjusting the operation of the timepiece need only perform the adjustment for this one row. The adjustment time is therefore one fourth that of a conventional mechanism.

A setting wheel 24 is pivotally mounted in the plane of the plate 14. It is designed to be driven by the fingers 15. A jumper spring 26 is arranged to cooperate with the teeth of the setting wheel 24 and help the setting wheel complete its jump after having been pushed by one of the fingers 15. One thus understands the usefulness of the play between the index 18 and the plate 14. In fact, this play allows the plate 14 to recoil without hindering the action of the jumper 26 at the end of a jump and without modifying the position of the cam 22.

More generally, the minute cam is made up of a snail comprising a single row of 60/N stages and designed to be driven by the movement at a rate of N revolutions per hour.

A pinion 27 meshes with the setting wheel 24. The gear ratios, on one hand, between the number of fingers comprised by the plate 14 relative to the toothing of the setting wheel 24 and, on the other hand, between the toothings of the setting wheel 24 and of the pinion 27, are determined such that the latter performs one revolution per hour. According to the example, the setting wheel 24 and the pinion 27 each comprise eight teeth. Given that the plate 14 turns at a rate of four revolutions per hour, the pinion 27 therefore pivots by one revolution in one hour. The pinion 27 is coaxial to and integral with a quarter cam 28 of the conventional type, which therefore also performs one revolution per hour.

A second plate 30 is mounted coaxial to and integral with the pinion 27 and the quarter cam 28. The plate 30 has a circular perimeter, interrupted by a finger 32 extending beyond the circle defined by the plate, in an essentially radial direction, the finger being bordered, on both sides, by a recess 33 running on this side of the circle.

A drive wheel 34 is arranged so as to cooperate with the finger 32. This wheel 34 has an opening 36 going through it, and which defines a spring organ 38, formed by the wheel itself. More particularly, the opening 36 is U-shaped and allows a portion of the wheel, dimensioned so as to have elastic properties and forming the spring 38, to remain between its branches.

The wheel 34 is mounted coaxial to an hour cam 40 of the traditional type. The cam 40 is free in rotation on the arbor of the wheel 34. A pin 42 is fixed to the cam 40 and assumes a position in the opening 36. It is capable of cooperating with the rim of the opening 36 or with the spring 38, thereby forming an elastic connection between the cam 40 and the wheel 34, making it possible to secure the jump of the hour cam, as will be better understood below upon reading about the operation of the mechanism.

The hour cam 40 is driven by a drive and blocking organ arranged so as to ensure driving of the hour cam by pitch and blocking thereof between two successive pitches.

In the illustrated embodiment, the drive and blocking organ comprises the plate 30 and the wheel 34. More precisely, the wheel 34 is provided with twelve notches 34*a* regularly distributed at its periphery and oriented along a radial direction and defining twelve pads 34*b*. The notches 34*a* are dimensioned such that the finger 32 can be housed there with very little play. The end of the pads 34*b* has a curvature 34*c* which fits the circular perimeter of the plate 30. On each side of this curve 34*c*, i.e. between the curve 34*c* and each of the notches 34*a*, each pad 34*b* has a bevel 34*d*, oriented such that two bevels 34*d* arranged opposite each other, on either side of a notch 34*a*, form a guide organ, in the shape of a funnel, narrowing toward the notch 34*a*. The centers of the plate 30 and of the wheel 34 are arranged such that the pads 34*b* are flush with the perimeter of the plate 30.

Thanks to the particular shape of the wheel 34 and the plate 30, when the pinion 27 is driven in rotation and the finger 32 is at the entry of a notch 34*a*, the finger can be inserted therein, without being blocked by the walls of the notch 34*a*, the upstream bevel 34*d* cooperating with the upstream recess 33. The finger can then push the wheel 34 and thereby cause the snail 36 to advance. When the finger comes out of the notch 34*a*, the downstream bevel 34*d* cooperates with the downstream recess, without blocking. The length of the finger 32 and the depth of the notch 34*a* are determined such that the advance made by pushing the finger allows the latter part, on the following revolution, to cooperate with the following notch 34*a*. When the finger 32 is not in the notch 34*a*, the wheel 34 is blocked in rotation, as the pad 34*b* is parallel to the perimeter of the plate 30 and cannot assume another position. Thus, when the finger 32 advances, its pitches are defined precisely by the jumper 26. Upon each revolution of the plate 30, the wheel 34 and the cam 40 move forward by jumping and their position is perfectly defined, which guarantees the accuracy of the ringing.

Advantageously, the quarter cam 28 and the hour cam 40 both advance by jumping, but using only one jumper, which is favorable to the level of energy consumed by the mechanism.

Furthermore, thanks to the elastic connection between the cam 40 and the wheel 34, if a jump occurs when the hour feeler-spindle is engaged on the lowest stage of the cam 40, the wheel 34 can advance and the cam 40 remain immobile abutting against the feeler-spindle, which results in winding the spring 38. Then, under the effect of the spring, the cam 40 will be able to return to its normal position relative to the wheel 34, after the feeler-spindle has returned to its locking position.

The description above was provided as a non-limiting illustration of the invention. Thus, in particular, the connections, with or without play, between the different elements, such as between the arbor 12 and the plates it supports, can be realized by means other than those described, within the grasp of one skilled in the art. By modifying its rotational speed, the drive wheel 34 could be provided with a different number of notches, but multiples of twelve. Moreover, although, in the embodiment described above, the quarter cam and the minute cam are mounted pivoting on two separate shafts, these could also be coaxial without being rigidly connected to each other. They could be connected by a setting wheel system ensuring the appropriate gear ratio between the two cams.

It is of course possible, without any particular effort for one skilled in the art, to mount a surprise-piece of the conventional type on the minute cam. The aim of the surprise-piece is to extend the highest stage at the time of the jump of the plate 14, so that the feeler-spindle does not fall on the lowest stage when the time to be rung is at the beginning of a quarter.

The invention claimed is:

1. A timepiece comprising a movement and a current-time ringing mechanism comprising an hour cam for providing information on the hour of the current time to an hour feeler-spindle, a quarter cam for providing information on the quarters of the current time to a quarter feeler-spindle, a minute cam for providing information on the minutes of the current time to a minute feeler-spindle, said cams being designed to be driven by the movement, the quarter cam and the minute cam being mounted pivotally and being free in relation to each other, and the minute cam being made up of a snail comprising a single row of 60/N stages and designed to be driven by the movement at a rate of N revolutions per hour, wherein the energy transmitted by the movement to said cams is brought to a train coaxial to the minute cam, then transmitted to a train coaxial to the quarter cam and, lastly, transmitted to a train coaxial to the hour cam.

2. The timepiece of claim 1, wherein said quarter cam and said minute cam are pivotally mounted on two separate shafts.

3. The timepiece of claim 1, wherein the minute cam is coaxial with a plate designed to transmit the energy received by the movement to the train coaxial to the quarter cam, the gear ratio between said plate and said train being determined such that the quarter cam performs one revolution per hour.

4. The timepiece according to claim 1, wherein N is equal to 4.

5. The timepiece of claim 3, wherein said plate drives a setting wheel cooperating with the train coaxial to the quarter cam, a jumper acting on said setting wheel or on said train in order to position the quarter cam.

6. The timepiece of claim 4, wherein said plate drives a setting wheel cooperating with the train coaxial to the quarter cam, a jumper acting on said setting wheel or on said train in order to position the quarter cam.

7. The timepiece of claim 5, characterized in that said plate and said minute cam are mounted with play in rotation relative to each other.

8. The timepiece of claim 6, characterized in that said plate and said minute cam are mounted with play in rotation relative to each other.

9. The timepiece according to claim 2, wherein N is equal to 4.

10. The timepiece according to claim 3, wherein N is equal to 4.

* * * * *